US005868543A

United States Patent [19]

McNeilus et al.

[11] Patent Number: 5,868,543

[45] Date of Patent: Feb. 9, 1999

[54] DROP FLOOR SPLIT BODY CHARGING HOPPER SYSTEM HAVING A DUAL LINEAR PACKING SYSTEM

[75] Inventors: Garwin B. McNeilus, Dodge Center; Wilbur R. Harris, Rochester, both of Minn.

[73] Assignee: McNeilus Truck and Manufacturing, Inc., Dodge Center, Minn.

[21] Appl. No.: 748,649

[22] Filed: Nov. 14, 1996

[51] Int. Cl.[6] ..... B65F 3/20

[52] U.S. Cl. ..... 414/512; 414/517; 414/525.6

[58] Field of Search ..... 414/406, 510–517, 414/525.2, 525.6

[56] References Cited

U.S. PATENT DOCUMENTS

| | | | |
|---|---|---|---|
| 3,901,394 | 8/1975 | Bowles | 414/513 X |
| 3,921,839 | 11/1975 | Herpich | 414/525.6 X |
| 3,955,694 | 5/1976 | Herpich | 414/513 |
| 3,966,096 | 6/1976 | Worthington . | |
| 4,096,956 | 6/1978 | Gaskin | 414/525.6 X |
| 4,113,125 | 9/1978 | Schiller . | |
| 4,221,527 | 9/1980 | Morrison | 414/525.6 X |
| 4,552,500 | 11/1985 | Ghibaudo et al. . | |
| 4,576,540 | 3/1986 | Derain et al. | 414/517 X |
| 4,877,366 | 10/1989 | De Filippi . | |
| 4,948,323 | 8/1990 | Gasparini | 414/525.6 X |
| 5,122,025 | 6/1992 | Glomski . | |
| 5,205,698 | 4/1993 | Mezey . | |
| 5,288,196 | 2/1994 | Horning et al. . | |
| 5,316,430 | 5/1994 | Horning et al. . | |
| 5,344,273 | 9/1994 | Radlein . | |
| 5,427,496 | 6/1995 | Ratledge, Jr. et al. . | |
| 5,458,452 | 10/1995 | Pellegrini . | |
| 5,484,246 | 1/1996 | Horning et al. . | |
| 5,560,713 | 10/1996 | Christenson | 414/513 X |
| 5,584,642 | 12/1996 | Huntoon | 414/525.2 |
| 5,681,140 | 10/1997 | Christenson | 414/406 X |

FOREIGN PATENT DOCUMENTS

| | | | |
|---|---|---|---|
| 0 314 238 | 5/1909 | European Pat. Off. . | |
| 0 492 699 A1 | 7/1992 | European Pat. Off. . | |
| 35 37 546 | 4/1987 | Germany . | |
| WO 94/05570 | 3/1994 | WIPO . | |
| 94/07774 | 4/1994 | WIPO | 414/406 |

*Primary Examiner*—James W. Keenan
*Attorney, Agent, or Firm*—Haugen and Nikolai P.A.

[57] ABSTRACT

A multi-compartment collection vehicle having a packing apparatus and a multi-compartment storage body wherein the packing apparatus includes a charging hopper divided into upper and lower portions each having corresponding dual linear packers. The upper charging hopper and upper compartment of the multi-compartment storage body are connected by a ramped floor. The dividing floor of the multi-compartment storage body is ramped from a relatively lower level aligned with the upper charging portion to a higher level defining the major longitudinal portion of the dividing floor. The ramped floor arrangement increases the holding capacity of the upper portion of the charging hopper, without significantly decreasing the holding capacity of the lower storage compartment.

19 Claims, 7 Drawing Sheets

DROP FLOOR SPLIT BODY CHARGING HOPPER SYSTEM HAVING A DUAL LINEAR PACKING SYSTEM

BACKGROUND OF THE INVENTION

I. Field of the Invention

This invention relates generally to material collection vehicles and those vehicles having divided storage bodies and to a loading system including a packing apparatus for charging refuse or recyclables into distinct predetermined storage body compartments in such a multi-compartment collection vehicle. More particularly, this invention relates to a receiving and packing apparatus having a divided charging hopper wherein dual linear-operating packing panels, each operating within a divided portion of the charging hopper, charge the refuse or recyclables into an associated compartment of the storage body. The charging hopper and storage body are divided so as to increase the relative holding capacity of the upper portion of the charging hopper, without significantly decreasing the holding capacity of the lower storage compartment.

II. Discussion of the Related Art

Refuse collection vehicles of the conventional variety generally include a storage compartment, a charging hopper, a loading mechanism, and a compacting mechanism all mounted on the vehicle. If the loading mechanism is of the front or side loading variety, the loading mechanism operates to engage, lift, and empty a container of interest into the associated charging hopper and the compacting mechanism directs the material from front to rear. When separated waste materials are hauled in designated compartments of the storage body of the collection vehicle, it is desirable to separately compact the material stowed in each compartment to allow a greater volume of material to be hauled.

The charging hopper typically includes a ram or packer panel which operates to pack refuse or recyclable material into the storage compartment. A partitioned charging hopper of a multi-compartment collection vehicle typically has an upper loading hopper separated by a floor and wall, and a separate packing system that is operated independently of that of the lower loading hopper. The wall is normally a transverse member that provides a rigid dividing wall that divides the receiving opening or access to the upper hopper (rear) from that of the lower hopper (front).

A divided side loading bucket may be used to load the segregated, collected materials into the predetermined portions of the charging hopper. When refuse is dumped into the hopper of the vehicle, the rearward portion of refuse contained in the loading bucket may land in the access to the upper hopper and the forward portion is received in the lower hopper. The loading bucket is typically divided or split fore and aft so that a first dedicated portion dumps into the lower hopper and a second dedicated portion dumps into the upper hopper.

A representative example of such a collection vehicle appears in U.S. Pat. No. 5,316,430, issued to Horning et al., which describes a divided vehicle for collecting, hauling, and delivering recyclable materials. The vehicle includes a divided charging hopper having a packer panel associated with the upper portion of the divided charging hopper. A double acting packing cylinder pushes and pulls or reciprocates the packer panel between a forward and aft position. The packing cylinder extends into and through the opening to the lower divided portion requiring material being loaded into the lower portion of the charging hopper to spill over the packing cylinders eventually reducing their useful life.

U.S. Pat. No. 5,484,246 also issued to Horning et al. discloses a similarly divided upper and lower charging hopper compartment. The upper portion of the charging hopper includes a ram that encloses a longitudinally extending packing cylinder. While this avoids exposing the cylinders to corroding refuse, it significantly reduces the holding capacity of the upper portion of the charging hopper.

While strides have been made, a need clearly persists for a packing apparatus having a divided charging hopper, wherein the packing mechanism of each portion of the charging hopper is not exposed to the refuse or recyclables as they are dumped into a predetermined portion of the charging hopper, yet where the available volume of the upper portion of the charging hopper is not reduced and further wherein the charging hopper is divided to increase the holding capacity of the upper portion of the charging hopper, without significantly decreasing the holding capacity of the lower storage compartment. The present invention meets these needs.

SUMMARY OF THE INVENTION

The purpose of the present invention is to provide a packing apparatus adapted for receiving and charging refuse or recyclables into preselected storage compartments of a multi-compartment collection vehicle having a multi-compartment storage body mounted to the vehicle and extending longitudinally therealong. The packing apparatus generally includes a divided charging hopper, first and second packers, and first and second means for linearly displacing the corresponding first and second packers.

A loading mechanism of either side loading (grabber or bucket) variety may be attached in communication with the charging hopper and adapted to load the refuse or recyclables into the charging hopper of the packing apparatus. A side loading bucket is described in greater detail in co-pending application Ser. No. 08/596,731, filed Feb. 5, 1996, and assigned to the same assignee as the present application, the entire disclosure of which is incorporated herein by reference.

A side loading grabber mechanism is described in greater detail in co-pending application Ser. No. 08/596,648, filed Feb. 5, 1996, now U.S. Pat. No. 5,720,589, issued Feb. 24, 1998, and assigned to the same assignee as the present application, the entire disclosure of which is also incorporated herein by reference. Of course, other mechanisms including front loading mechanisms of known construction may replace the side loading bucket or grabber and the width of the charging hopper adjusted accordingly.

The charging hopper is mountable to the collection vehicle forward of the multi-compartment storage body and adapted to receive material and to charge material into a preselected compartment of the multi-compartment storage body of the vehicle. The charging hopper includes a transverse dividing wall and floor which divide the charging hopper into an upper and lower portion. The upper portion of the multi-compartment charging hopper includes a dropped floor, the storage body having a ramped transition connecting the charging hopper dividing floor, and the floor of the upper storage body compartment, wherein material loaded into the upper portion of the charging hopper is moved up the ramped or sloped floor and into the upper compartment of the storage body. The ramped floor allows the charging hopper dividing floor to be positioned lower relative to the top opening of the charging hopper, thereby increasing the holding capacity within the upper portion of the charging hopper.

Separate packer mechanisms are positioned within the lower and upper portions of the charging hopper respectively. Each packer is linearly displaceable between a stowed and packing position for packing materials into the corresponding compartment of the multi-compartment storage body. A wiper panel is affixed above each packer angling down and rearward toward the floor of each corresponding storage compartment. When the packer is in the stowed position, the wiper shields the packer panel and directs collection materials towards the storage compartment opening. A corresponding follower panel is also provided and is pivotally attached at one end to the packer panel as by polymer bushing devices preferably low friction. The opposite end includes follower rollers, which are preferably self lubricating, rotatably attached and extending therefrom that align and roll as followers on a track such that as the packer panel is displaced forward to its fully extended, packing position, the follower panel pivots and extends over and so follows the packer panel along the track.

Each packer preferably rides on a friction reducing wear surface system including bottom rails or tracks, guide shoes and wear pads which direct and align the panel as it is displaced between the stowed and packing positions. A complete description of such a system including the guide shoes and wear pads suitable for use with the present invention is shown and described in U.S. Application Ser. No. 08/717,485, filed on Sept. 20, 1996(now abandoned), titled "REPLACEABLE WEAR SYSTEM", which is assigned to the same assignee as the present invention, the contents of which are also hereby incorporated by reference in their entirety for any necessary purpose to provide added details of the packer panel, wear shoes or wear pads.

Each packer panel is linearly displaced by a pair of packing cylinders. The upper packing cylinders are attached between the dividing wall and upper packer panel and the lower packing cylinders are attached between the lower portion of the charging hopper and the first packer panel. The packing cylinders are crossed or angled in an X formation in the stowed position to thereby reduce the amount of space required between the diving wall or hopper and the packer panel. In this manner, the available holding capacity of each of the upper and lower charging hopper portions is increased.

OBJECTS

It is accordingly a principle object of the present invention to provide an improved charging system and packing apparatus for a multi-compartment collection vehicle that increases the holding capacity of an upper charging hopper, without significantly decreasing the holding capacity of the lower compartment.

Another object of the invention is to provide a dual linear packing system that reduces the amount of space required to mount the packing cylinders of each packer panel.

Still another object of the invention is to provide a packing apparatus that isolates the packing cylinders from the flow of collection material, while reducing the amount of space required to mount the packing cylinders of each packer panel.

These and other objects, as well as these and other features and advantages of the present invention will become readily apparent to those skilled in the art from a review of the following detailed description of the preferred embodiment in conjunction with the claims and accompanying drawings keeping in mind that like numerals in the several views refer to corresponding parts.

DETAILED DESCRIPTION

Figure 1:
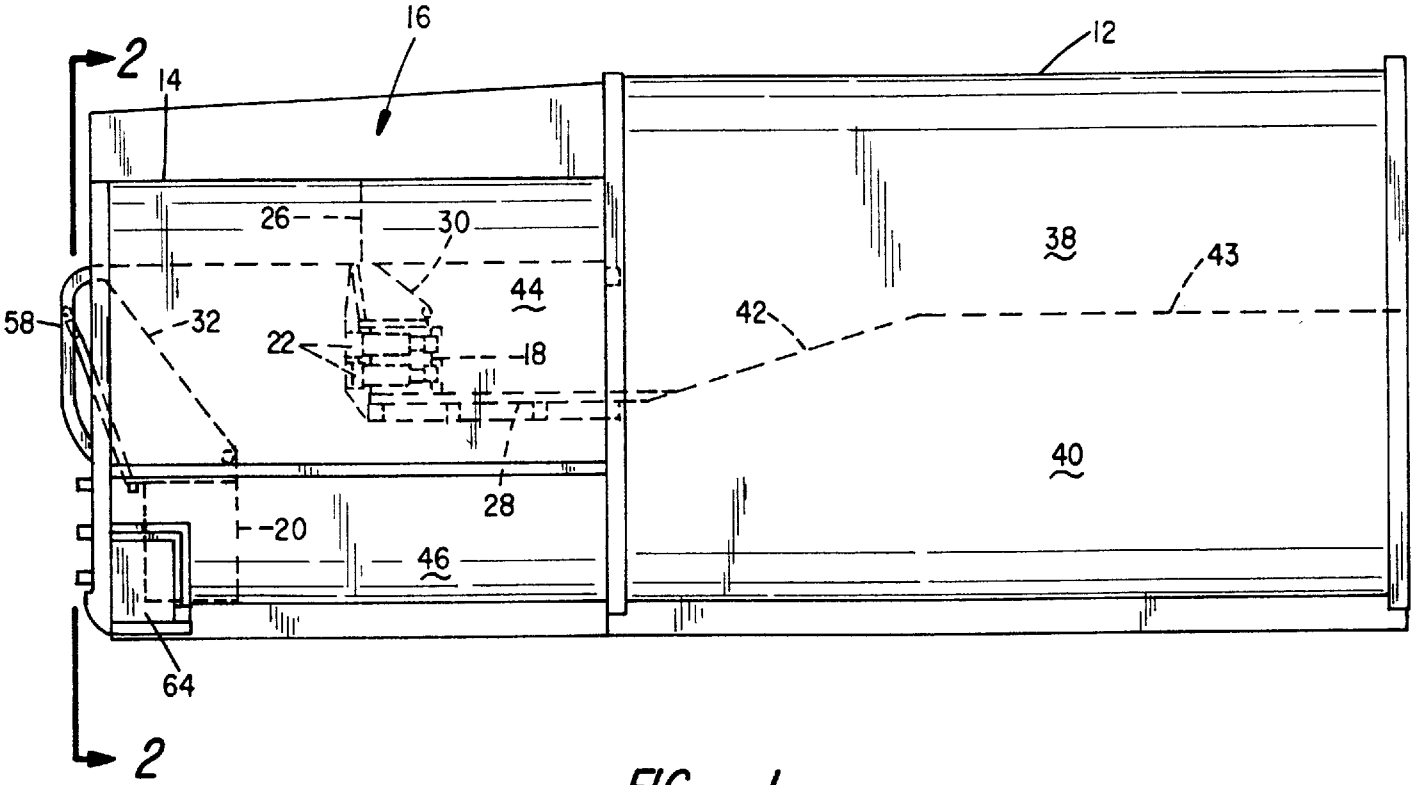
FIG. 1 is a side elevational view of a truck body showing the receiving and packing apparatus of the present invention aligned and engaged with a multi-compartment storage body, both of which are removed from the collection vehicle.

Referring first to FIG. 1, the material receiving and packing apparatus of the present invention is shown aligned and engaged with a multi-compartment storage body 12. The receiving and packing apparatus generally includes a charging hopper 14 having an open top end indicated by lead line 16, upper and lower packer panels 18 and 20 respectively, upper and lower dual linear packing cylinders 22 and 24 (FIG. 2) respectively, a dividing wall 26, a dividing floor 28, upper and lower wiper panels 30 and 32 respectively, and upper and lower follower panels 34 and 36 respectively.

The storage body 12 is shown having upper and lower storage compartments 38 and 40 respectively, and a ramped dividing floor 42. The ramped floor or partition 42 creates a transition between the dividing floor 28 of the charging hopper 14 and a portion of the floor 43 dividing the upper and lower storage compartments 38 and 40 of the storage body 12. When collection material is emptied into the upper portion 44 of the hopper 14 and packed into the upper storage compartment 38, the material moves up the ramp 42 and into the major portion of the upper storage compartment 38.

The ramped floor 42 allows the floor 28 of the upper charging hopper portion 44 to be dropped or positioned lower relative to the open top end 16 in the charging hopper 14. By lowering the floor 28 of upper charging hopper portion 44, the holding capacity of the upper charging hopper portion 44 is increased without raising the height of partition 26 and outer walls of the charging hopper 14. Ideally the upper charging hopper floor 28 is lowered a sufficient amount such that the holding capacity of the upper charging hopper 44 is approximately equal to the holding capacity of the lower charging hopper portion 46. In this manner, approximately equal amounts of collection material can be dumped into the upper and lower charging hopper portions 44 and 46, before a packing cycle should be initiated for each. Thus, the packing of packer panels 18 and 20 may both be interconnected to a single hydraulic control. Of course, if separate independent packing operations by the upper and lower packer panels 18 and 20 are desired, separate hydraulic controls may be connected to the upper and lower pair of packing cylinders 22 and 24. The cycle time or intervals of the upper and lower packer panels 18 and 20, which operate the packer panels 18 and 20 between the stowed and packing positions, may be controlled to cycle either continuously or intermittently on a timed or manually initiated basis and also may operate in concert or independently. The hydraulic system allows pressure relief at different pressures for simultaneous or sequential packing. One such hydraulic system is described in greater detail below in conjunction with FIG. 8.

Figure 2:
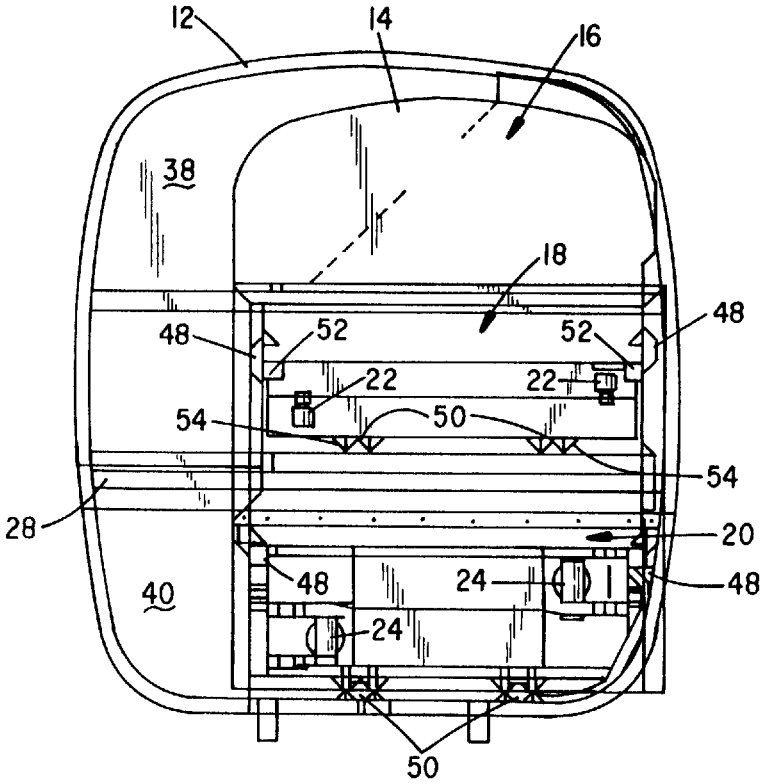
FIG. 2 is a partial cross-sectional view taken along line 2—2 of FIG. 1.

Referring next to FIG. 2, the upper and lower packer panels 18 and 20 slide within their respective upper and lower charging hopper portions 44 and 46 along pairs of side guides 48 and bottom support tracks 50. Wear pads 52 and wear or guide shoes 54, respectively, are slidingly engaged with each packer panel 18 and 20 and are adapted to slide along the corresponding wear surface. The wear or guide system of the invention employs floating wear shoes or bottom pads 54 that have recesses correspondingly matched to the upper surfaces of closed, spaced, parallel bottom tracks or rails 50. The shoes are retained by removable stop plates which overlay a portion of the ends of the shoes and fasten only to the packer itself (assisted by gravity). Separate upper floating and similarly retained wear pads 52 are included which contact inwardly directed upper side wall projecting surfaces 48 to prevent vertical displacement or "ride-up" of the packer with respect to items being moved. As noted above, the wear shoes and wear pads are further described in co-pending application, Ser. No. 08/717,485, the complete disclosure of which has been incorporated herein by reference. It should be noted that the wear shoes and/or wear pads can be made of any suitable self-lubricating polymer or a modified polymer material or of conventional materials including steel, bronze, brass, or any combination.

Figure 3:
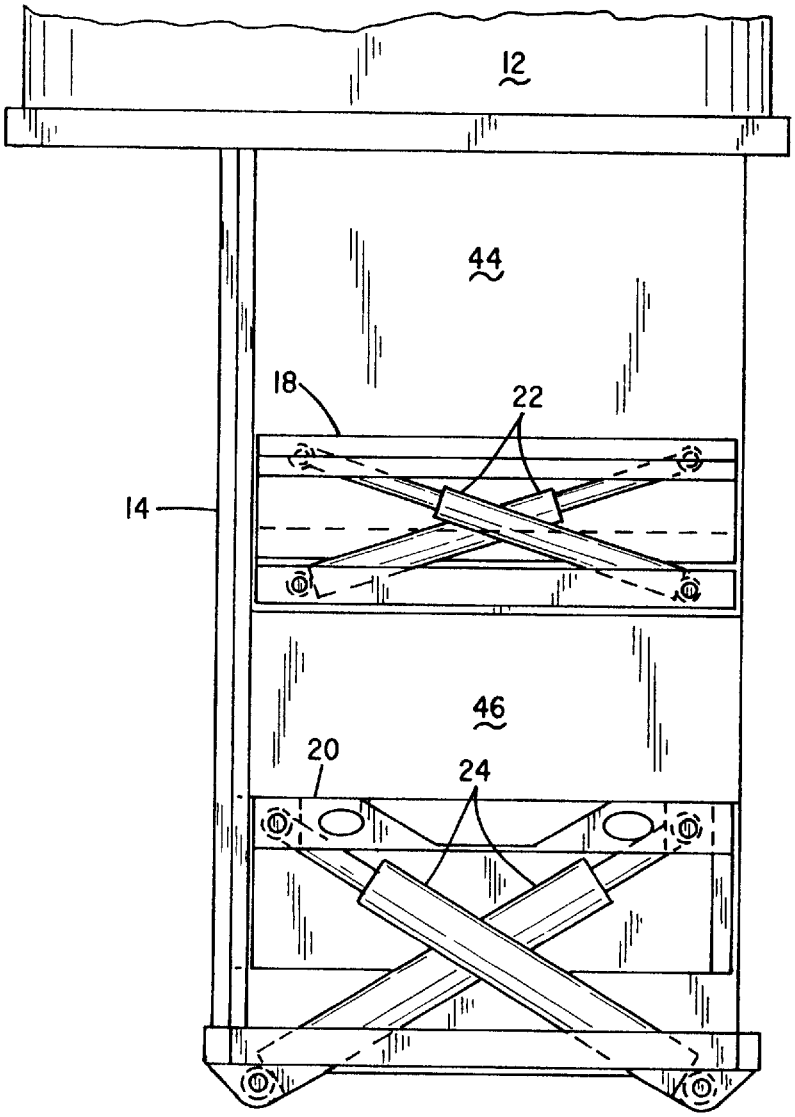
FIG. 3 is a fragmentary top view of the receiving and packing apparatus and part of the storage body of the type shown in FIG. 1.

FIG. 3 illustrates the attachment and arrangement of each pair of packing cylinders 22 and 24 to the corresponding charging hopper portion 44 and 46 and packer panels 18 and 20. Without limitation, the packing cylinders may be of a hydraulic, pneumatic or other known construction with double-acting hydraulic cylinders being preferred. Each packing cylinder is pivotally attached between an end of the packer panel and the opposite end of the wall of the corresponding charging hopper portion, the rod end being preferably attached to the packer panel. This forms an X pattern with one cylinder being mounted above the other. In this manner, the pairs of packing cylinders 22 and 24 are sheltered by the corresponding packer panels 18 and 20, followers 34 and 36, and wiper panels 30 and 32, from collection material that otherwise might be dumped in the space behind (or on the cylinder side) the associated packing panel contacting the cylinders or pivots in charging hopper portion 44 and 46 (see also FIGS. 1 and 4). Also, the required fore and aft distance between the connection points of the ends of the packing cylinders is reduced by the X pattern.

Figure 4:
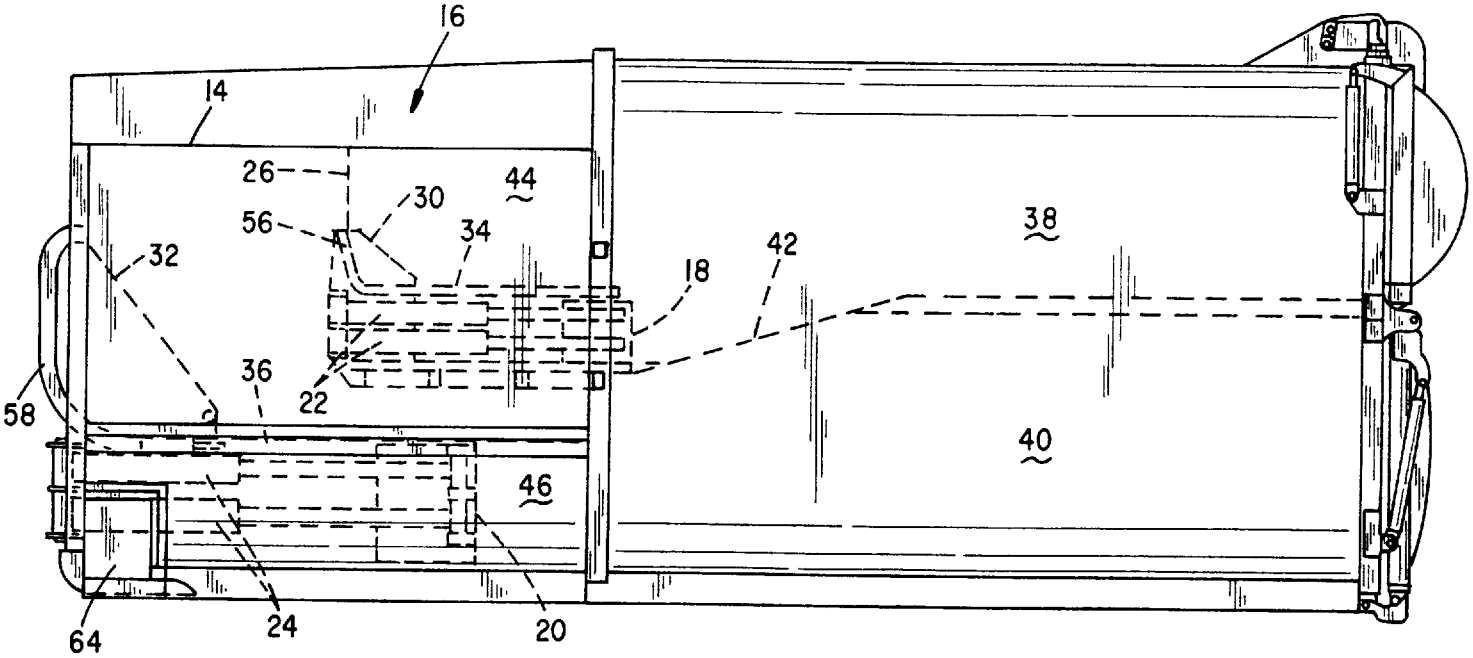
FIG. 4 is a side elevational view of the packing apparatus and storage body of the type shown in FIG. 1, showing the upper and lower packer panel in the fully extended packing position.
Figure 5:
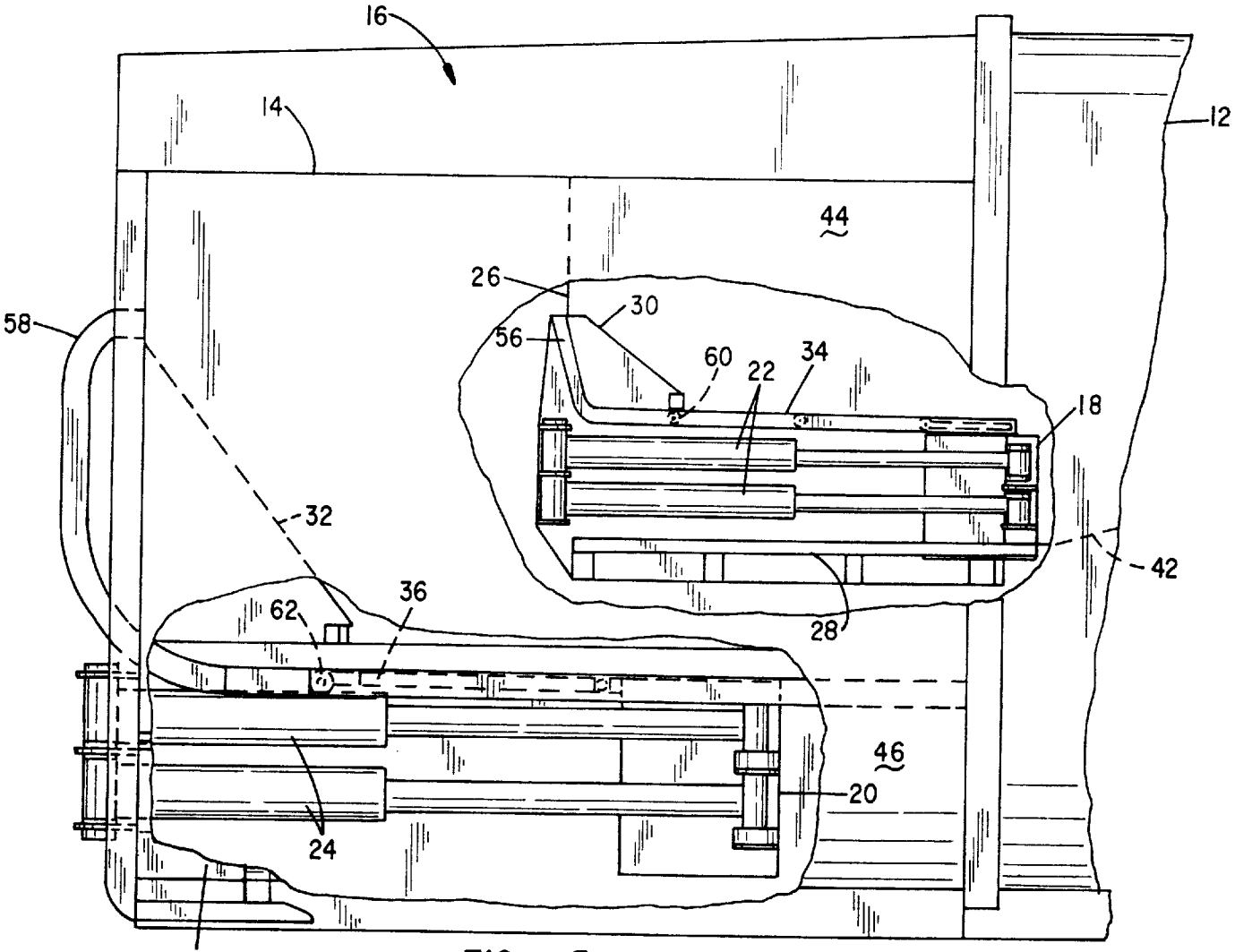
FIG. 5 is a greatly enlarged view of detailing the packing apparatus shown in FIG. 4.

FIGS. 4 and 5 show the relative position of the packer panels 18 and 20 and the corresponding pairs of packing cylinders 22 and 24, when the packer panels 18 and 20 are slid to a fully extended position (rearward with respect to the vehicle and the hopper positions). The upper packer panel 18 slides partially into an opening formed in the upper storage compartment 38. When the upper packer panel 18 slides rearward to a packing position, any collection materials positioned on the dividing floor in front of the packer panel 18 will be pushed up the ramped floor 42 of the multi-compartment storage body and into the upper storage compartment 38.

As the upper packer panel 18 slides rearward, corresponding follower panel 34 slides along a pair of rails 56. The follower panel 34 is pivotally attached at one end to the packer panel 18 and at the opposite end, a pair of polymer follower rollers 60 are rotationally attached to the packer panel and extending therefrom. The rollers 60 align and roll on the pair of recessed rails 56 such that as the packer panel 18 is displaced rearward to its packing position, the follower panel 34 pivots and follows the packer panel 18 along the rails 56 covering the area between the partition wall 26 and the packer panel 18.

A wiper panel 30 is affixed above the packer panel 18 angling down and rearward toward the ramped floor 42 of the storage compartment. When the packer panel 18 is in the stowed position, the wiper panel 30 shields the packer panel 18 and directs collection materials towards the storage compartment opening. When the packer panel 18 is slid rearward, the wiper panel 30 deflects dumped collection material onto the follower panel 34. As the packer panel 18 is returned to its stowed position, the follower panel 34 slides under the wiper panel 30, and the material resting on the follower panel is wiped or deflected to the floor 28 in front or on the packing face side of the packer panel 18. Those skilled in the art will appreciate that an access door or opening may be provided in the dividing wall 26, thereby allowing the operator to access the upper pair of packing cylinders 22.

The lower packer panel 20 is positioned in the lower charging hopper portion 46 and operates similarly to the operation described for the upper packer panel 18. The lower packer panel 20 pushes materials dumped into the lower charging hopper portion 46 towards an opening of the lower storage compartment 40 of the storage body 14. The lower packer panel 20 has associated therewith a follower panel 36 and a wiper panel 32. The follower panel 36 includes a pair of follower rollers 62 that roll along hollow rails as at 58, positioning the follower panel 36 over the packing cylinder panel 20. An access door 64 is provided to allow access to the lower pair of packing cylinders from the outside of the charging hopper 14.

Figure 6:
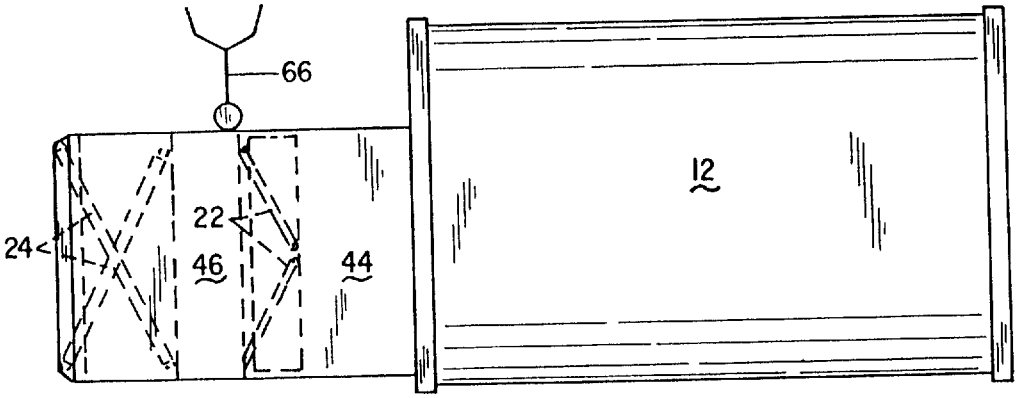
FIG. 6 is a top view of the packing apparatus and storage body of the type shown in FIG. 1 featuring a popular swivel grabber mechanism attached to the outer portion of the charging hopper of the packing apparatus.
Figure 7:
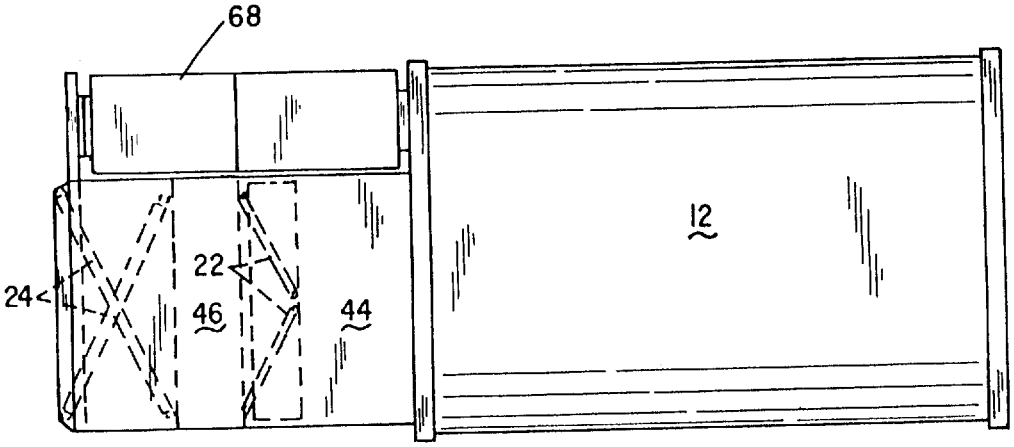
FIG. 7 is a top view of the packing apparatus and storage body of the type shown in FIG. 1 employing a side bucket loading mechanism attached to the outer portion of the charging hopper of the packing apparatus.

FIGS. 6 and 7 demonstrate two alternative loading or lift and dump embodiments. In FIG. 6 a swivel mounted grabber type mechanism 66 is attached next to a recessed side of the charging hopper 14. The grabber mechanism 66 includes a swivel mount and articulated arm. As noted above, co-pending application Ser. No. 08/596,648, which has been incorporated herein by reference, describes the grabber mechanism 66 in greater detail. FIG. 7 shows a divided side loading bucket 68, which operates in a side rail system between load, lift and dump positions. A side loading bucket suitable for use with the packing apparatus of the present invention is described in greater detail in co-pending application Ser. No. 08/596,731, which has been incorporated herein by reference.

Figure 8:
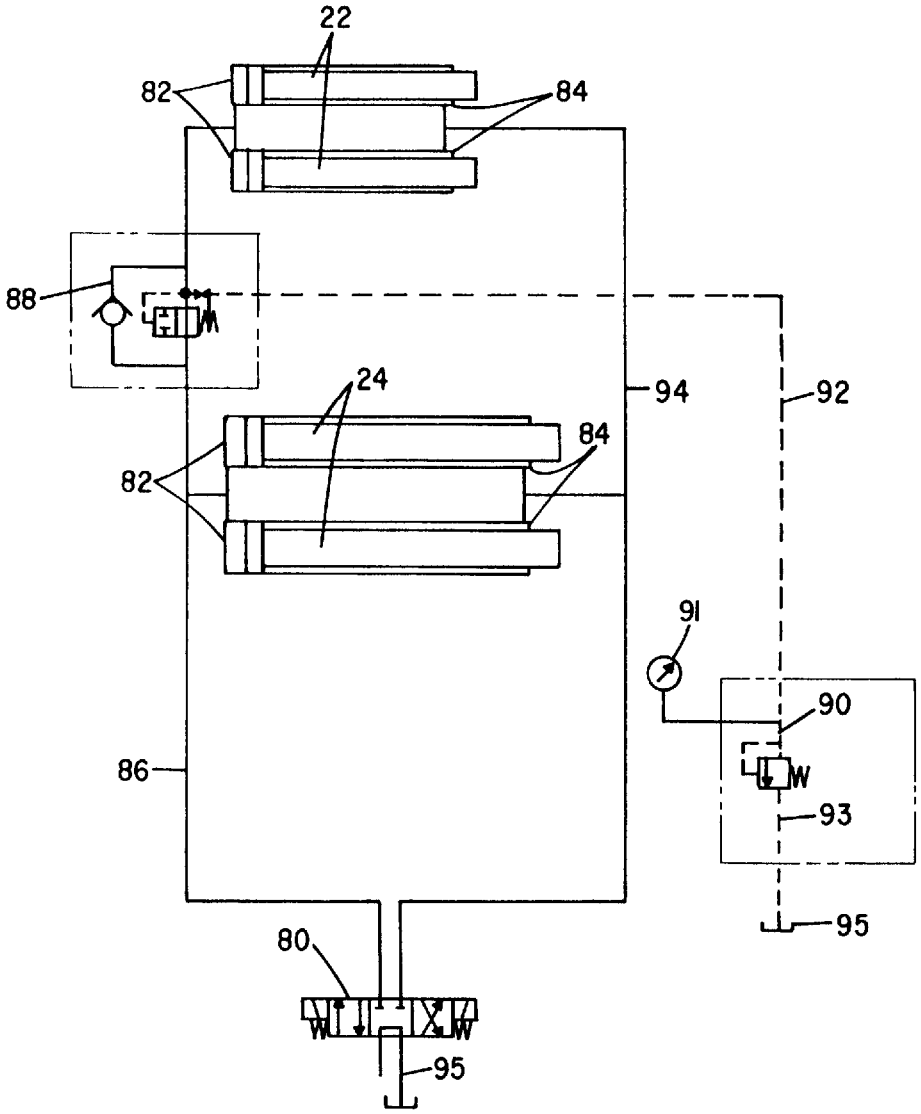
FIG. 8 is a schematic hydraulic diagram of a system suitable for operating the packing apparatus in accordance with the present invention.

FIG. 8 is a hydraulic schematic for operating the upper and lower packers simultaneously at different ram pressures. Typically, the upper cylinders are operated at a reduced pressure and so at a lower ram force. Upper and lower pairs of double-acting packing cylinders 22 and 24 are connected in parallel to operate together. A flow control valve 80 controls the flow of fluid to either the head end 82 or rod end 84 of each pair of cylinders 22 and 24. As indicated, the flow control valve 80 may be positioned in a neutral (central), packing (left) or retracting (right) positions. In order to extend the cylinders for the packing power stroke, the fluid is supplied to the head ends 82 of the upper and lower packing cylinders 22 and 24, under a predetermined pressure, through line 86 with line 94 connected to return rod and fluid to drain or sump. To retract the rods of each pair of dual-acting packing cylinders 22 and 24, flow control valve 80 is switched right-to supplying pressurized fluid to the rod ends 84 of the upper and lower packing cylinders 22 and 24, through line 94, line 86 being thus connected to return line or drain line.

A pressure relief valve or pilot valve 88 is connected in the fluid line 86 between the upper and lower packing cylinders 22 and 24. This valve only limits the compacting pressure to the upper cylinders. A controller 90 with pressure readout 91 is coupled to the pilot valve via dashed line 92. The dashed line 92 signifies a control line connection: a bleed line 93 to a sump 95. The controller 90 is set to close pilot valve 88, and prevent further extension of cylinders 22, whenever the pressure of the hydraulic fluid within the valve 88 exceeds a predetermined amount as set at controller 90. When the valve 88 is closed due to over pressure, connection of the common fluid supply to the upper cylinders is severed and the upper cylinder pressure is allowed to bleed through 92, 93 until the preset pressure is reached. The controller 90 opens valve 88 once the pressure falls below the predetermined amount. In this manner, the valve 88 cycles as required to maintain the desired maximum power stroke pressure supply to the upper cylinders 22. Of course, this control is necessary only for the packing or power stroke where reduced maximum power may be desired to be applied as to glass recyclables, for example, in the upper compartment. The return stroke need not be modulated. In this manner, the upper and lower pair of packing cylinders may be simultaneously operated at different predetermined fluid pressures.

This invention has been described herein in considerable detail in order to comply with the Patent Statutes and to provide those skilled in the art with the information needed to apply the novel principles and to construct and use such specialized components as required. However, it is to be understood that the invention could be carried out by specifically different equipment and devices, and that various modifications, both as to the equipment details and operating procedures, can be accomplished without departing from the scope of the invention itself.

What is claimed is:

1. A material receiving and packing apparatus for receiving and charging refuse or recyclables into a preselected storage compartment of a multi-compartment collection vehicle having a multi-compartment storage body mounted to the vehicle and extending longitudinally therealong, wherein a loading mechanism loads the refuse or recyclables into a charging hopper of the receiving and packing apparatus, said receiving and packing apparatus comprising:

(a) a charging hopper having a dividing wall and floor separating the charging hopper into an upper and a lower portion, wherein the charging hopper is mountable to the collection vehicle forward of the multi-compartment storage body and adapted to charge material into preselected compartments of the multi-compartment storage body;

(b) a first packer panel positioned within the lower portion of the charging hopper and linearly displaceable between stowed and packing positions for packing materials into a lower compartment of the multi-compartment storage body;

(c) a second packer panel positioned within the upper portion of the charging hopper and linearly displaceable between stowed and packing positions for packing materials into an upper compartment of the multi-compartment storage body;

(d) a first pair of packing cylinders contained within the lower portion of the charging hopper and attached between the lower portion of the charging hopper and the first packer panel for linearly displacing the first packer panel between the stowed and packing positions thereof;

(e) a second independently operated pair of packing cylinders contained within the upper portion of the charging hopper and attached between the dividing wall and the second packer panel for linearly displacing the second packer panel between the stowed and packing positions thereof;

(f) a first wiper panel positioned within the charging hopper and centered above the first packer panel when the first packer panel is in the stowed position;

(g) a first follower panel attached to the first packer panel and aligned on a first track such that as the first packer panel is advanced toward the packing position, the first follower panel pivots and follows the first packer panel along the first track;

(h) a second wiper panel positioned within the charging hopper and centered above the second packer panel when the second packer panel is in the stowed position;

(i) a second follower panel attached to the second packer panel and aligned on a second track such that as the second packer panel is advanced toward the packing position, the second follower panel pivots and follows the second packer panel along the second tracks; and (j) wherein the upper portion of charging hopper has an upper hopper floor, and the upper compartment of the multi-compartment storage body includes an upper body floor, said upper hopper floor being lower than said upper body floor, said upper body floor having a ramped transition aligned with said upper hopper floor, wherein material loaded into said upper portion of the charging hopper is moved up said ramped transition and into a corresponding portion of the storage body by the second packer panel.

2. The receiving and packing apparatus as recited in claim 1, wherein the first and second follower panels pivot on hinges comprising self-lubricating polymer bushings.

3. The receiving and packing apparatus as recited in claim 1, wherein the first and second follower panels include polymer rollers that roll along the first and second tracks respectively.

4. The receiving and packing apparatus as recited in claim 1, wherein each of the first and second packer panels further include wear shoes and guide shoes.

5. The receiving and packing apparatus as recited in claim 1, wherein the loading mechanism includes a grabber.

6. The receiving and packing apparatus as recited in claim 1, wherein the loading mechanism includes a divided bucket.

7. The receiving and packing apparatus as recited in claim 1, wherein the first and second pairs of packing cylinders are attached to form an X pattern.

8. The receiving and packing apparatus as recited in claim 1, including means for operating said first and second pairs of packing cylinders simultaneously at different packing pressures.

9. A receiving and packing apparatus for receiving and charging refuse or recyclables into a preselected storage compartment of a multi-compartment collection vehicle having a multi-compartment storage body mounted to the vehicle and extending longitudinally therealong, wherein a loading mechanism loads the refuse or recyclables into a charging hopper of the receiving and packing apparatus, said receiving and packing apparatus comprising:

(a) a charging hopper having a dividing wall and floor separating the charging hopper into an upper and a lower portion, wherein the charging hopper is mountable to the collection vehicle forward of the multi-compartment storage body and adapted to charge material into a preselected compartment of the multi-compartment storage body, said upper portion of the multi-compartment storage body including a floor having a ramped transition between the upper portion of the charging hopper and a major portion of the storage body, wherein material loaded into said upper portion of the charging hopper is moved up said ramped floor and into said major portion of said storage body;

(b) a first packer panel positioned within the lower portion of the charging hopper and linearly displaceable between stowed and packing positions for packing materials into a lower compartment of the multi-compartment storage body;

(c) a second packer panel positioned within the upper portion of the charging hopper and linearly displaceable between stowed and packing positions for packing materials into an upper compartment of the multi-compartment storage body;

(d) a first pair of packing cylinders contained within the lower portion of the charging hopper and attached between the lower portion of the charging hopper and the first packer panel for linearly displacing the first packer panel between the stowed and packing positions thereof;

(e) a second independently operated pair of packing cylinders contained within the upper portion of the charging hopper and attached between the dividing wall and the second packer panel for linearly displacing the second packer panel between the stowed and packing positions thereof;

(f) a first wiper panel positioned within the charging hopper and centered above the first packer panel when the first packer panel is in the stowed position;

(g) a first follower panel attached to the first packer panel and aligned on a first track such that as the first packer panel is advanced toward the packing position, the first follower panel pivots and follows the first packer panel along the first track;

(h) a second wiper panel positioned within the charging hopper and centered above the second packer panel when the second packer panel is in the stowed position; and (i) a second follower panel attached to the second packer panel and aligned on a second track such that as the second packer panel is advanced toward the packing position, the second follower panel pivots and follows the second packer panel along the second track.

10. The receiving and packing apparatus as recited in claim 9, wherein the first and second follower panels pivot on hinges comprising self-lubricating polymer bushings.

11. The receiving and packing apparatus as recited in claim 9, wherein the first and second follower panels include polymer rollers that roll along the first and second tracks respectively.

12. The receiving and packing apparatus as recited in claim 9, wherein each of the first and second packer panels further include wear shoes and guide shoes.

13. The receiving and packing apparatus as recited in claim 9, wherein the loading mechanism includes a grabber.

14. The receiving and packing apparatus as recited in claim 9, wherein the loading mechanism includes a divided bucket.

15. The receiving and packing apparatus as recited in claim 9, wherein the first and second pairs of packing cylinders are attached to form an X pattern.

16. The receiving and packing apparatus as recited in claim 9, including means for operating said first and second pairs of packing cylinders simultaneously at different packing pressures.

17. A collection apparatus for handling a plurality of segregated materials, the apparatus comprising:

(a) a charging hopper having an access for receiving refuse comprising front and rear top access openings, which respectively lead into lower and upper charging hopper compartments;

(b) an uppers, independently operable packing system in said upper charging hopper compartment comprising a linearly operating packing panel, a pair of upper hydraulic packing cylinders mounted behind said upper packing panel and an upper wiper panel and upper follower panel slidably attached between said upper charging hopper and rotatably attached to said upper packer panel which cooperate to prevent waste material from falling behind said upper packing panel regardless of the relative linear position of said upper packing panel when material is charged into said upper charging hopper compartment;

(c) a lower packing system in said lower charging hopper compartment comprising a linearly operating packing panel, a pair of lower hydraulic packing cylinders mounted behind said lower packing panel, a lower wiper panel and lower follower panel slidably attached between said lower charging hopper and rotatably attached to said lower packer panel which cooperate to prevent waste material from falling behind said lower packing panel regardless of the relative linear position of said lower packing panel when material is charged into said lower charging hopper compartment;

(d) a storage body having upper and lower storage compartments respectively served by said upper and lower packing systems;

(e) wherein said upper charging hopper compartment includes an upper floor and wherein said upper storage compartmernt of said storage body includes a floor that is higher than that of said upper charging hopper and including a ramp means connecting said upper floor of said charging hopper and said floor of said upper storage compartment.

18. The apparatus of claim 17, further including a means for operating said upper and lower packing cylinders simultaneously and continuously.

19. The apparatus of claim 18, wherein said means for operating said upper and lower packing cylinders includes means for operating said upper packing cylinders at a reduces power stroke pressure.

* * * * *